US008522964B1

(12) United States Patent
Pledger

(10) Patent No.: US 8,522,964 B1
(45) Date of Patent: Sep. 3, 2013

(54) JEWELRY STORAGE CASE

(76) Inventor: Patricka S. Pledger, High Springs, FL (US)

( * ) Notice: Subject to any disclaimer, the term of this patent is extended or adjusted under 35 U.S.C. 154(b) by 0 days.

(21) Appl. No.: 12/985,895

(22) Filed: Jan. 6, 2011

(51) Int. Cl.
*A45C 11/04* (2006.01)

(52) U.S. Cl.
USPC ..... 206/6.1; 206/523; 206/575

(58) Field of Classification Search
USPC ..... 206/6.1, 566, 303, 581, 575, 523, 206/490, 579, 578, 589
See application file for complete search history.

(56) References Cited

U.S. PATENT DOCUMENTS

| | | | | | |
|---|---|---|---|---|---|
| 2,813,622 | A * | 11/1957 | Lancellotti | 206/6.1 |
| 2,988,205 | A * | 6/1961 | Barlow | 206/303 |
| 3,384,220 | A * | 5/1968 | Linstead | 206/574 |
| 3,840,113 | A * | 10/1974 | Bartleson | 206/575 |
| 4,120,394 | A * | 10/1978 | Soltes | 206/6.1 |
| 4,153,154 | A | 5/1979 | Ruscher | |
| 5,035,319 | A | 7/1991 | Kunisch | |
| 5,121,833 | A | 6/1992 | Lindsay et al. | |
| 5,299,683 | A * | 4/1994 | Poole | 206/77.1 |
| 5,540,324 | A * | 7/1996 | Knapp | 206/6.1 |
| D418,347 | S | 1/2000 | Dragonette | |
| 6,053,322 | A * | 4/2000 | Kim et al. | 206/575 |
| 6,202,851 | B1 * | 3/2001 | Walker | 206/579 |
| 6,422,384 | B1 | 7/2002 | Roederer | |
| 6,550,618 | B2 | 4/2003 | Peterson | |
| 7,946,423 | B2 * | 5/2011 | Gupta | 206/564 |
| 2005/0178693 | A1 * | 8/2005 | Gupta | 206/574 |
| 2010/0200436 | A1 * | 8/2010 | Gupta | 206/205 |

* cited by examiner

*Primary Examiner* — David Fidei

(57) ABSTRACT

A jewelry storage case is provided for organizing jewelry into separate labeled compartments within a portable case. The case includes a housing having an interior and a top hingedly coupled to a bottom. A plurality of lower cups is positioned in the bottom of the housing. Each lower cup is configured for receiving and holding a pair of earrings. An elongated lower channel is positioned in the bottom of the housing. An elongated lower wall is positioned in the lower channel defining a lower inner compartment and a lower outer compartment configured for holding a bracelet and a necklace respectively.

12 Claims, 3 Drawing Sheets

JEWELRY STORAGE CASE

BACKGROUND OF THE DISCLOSURE

Field of the Disclosure

The disclosure relates to jewelry storage devices and more particularly pertains to a new jewelry storage device for organizing jewelry into separate labeled compartments within a portable case.

SUMMARY OF THE DISCLOSURE

An embodiment of the disclosure meets the needs presented above by generally comprising a housing having an interior and a top hingedly coupled to a bottom. A plurality of lower cups is positioned in the bottom of the housing. Each lower cup is configured for receiving and holding a pair of earrings. An elongated lower channel is positioned in the bottom of the housing. An elongated lower wall is positioned in the lower channel defining a lower inner compartment and a lower outer compartment configured for holding a bracelet and a necklace respectively.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
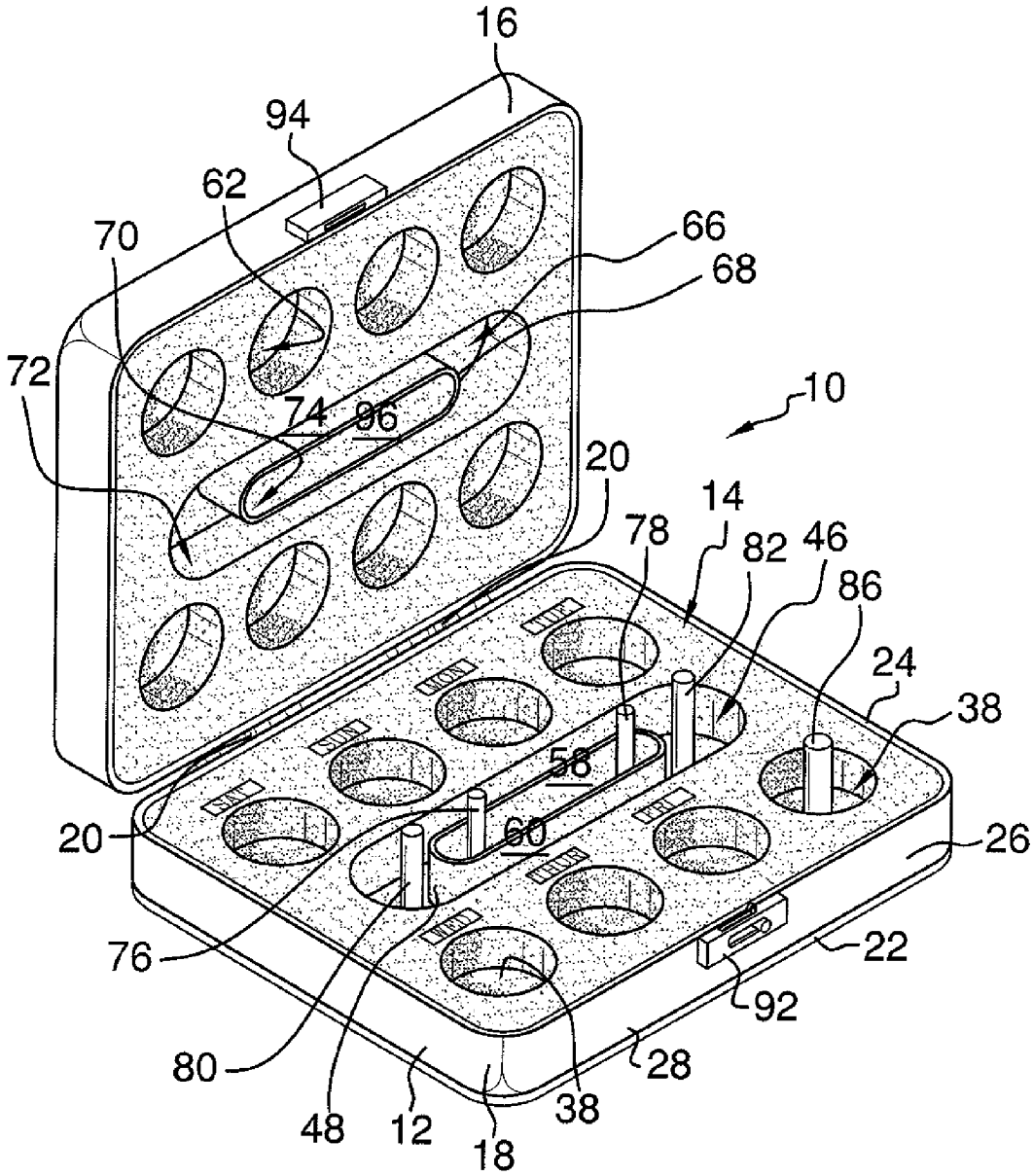
FIG. 1 is a front top side perspective view of a jewelry storage case according to an embodiment of the disclosure.
Figure 2:
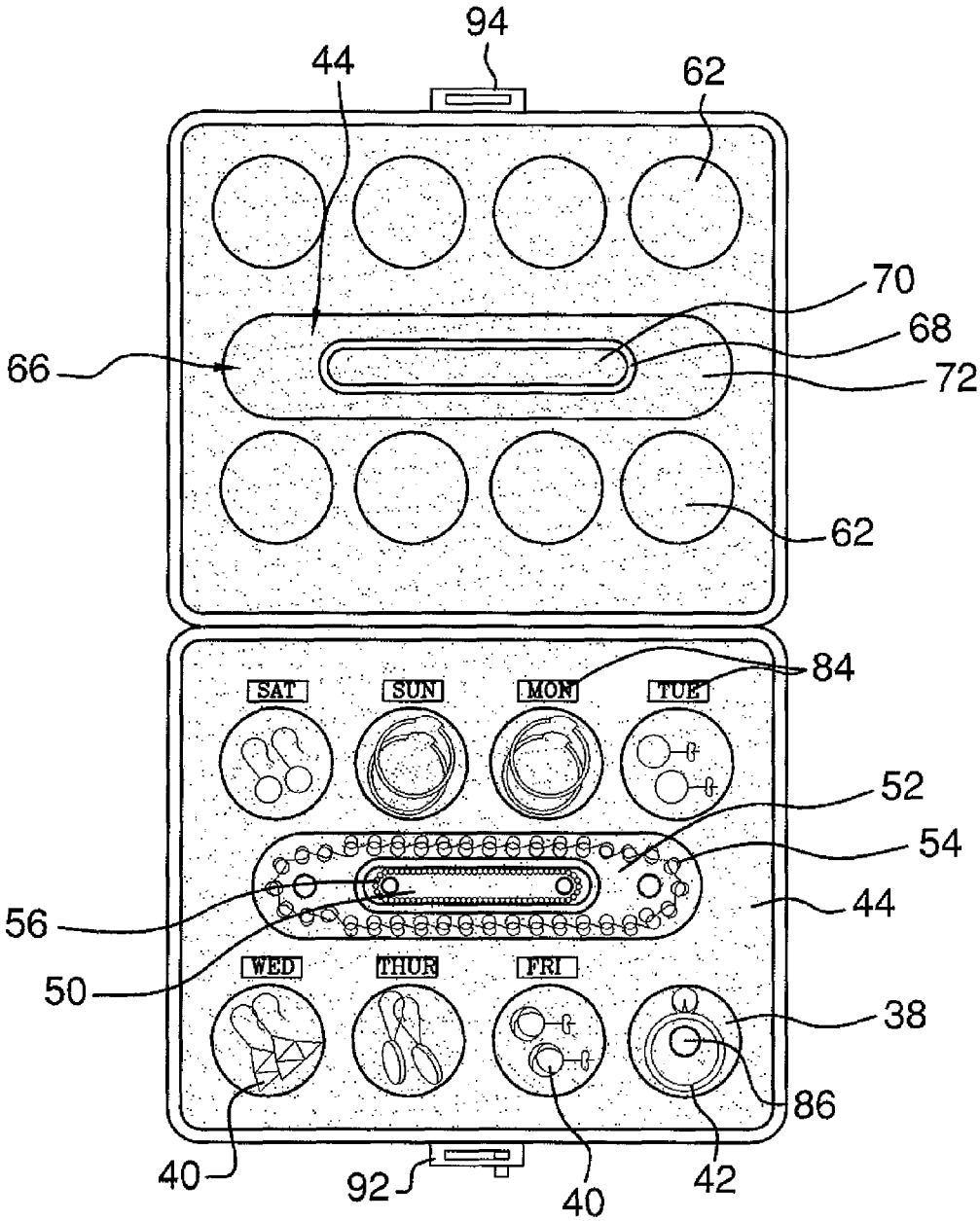
FIG. 2 is a top view of an embodiment of the disclosure.
Figure 3:
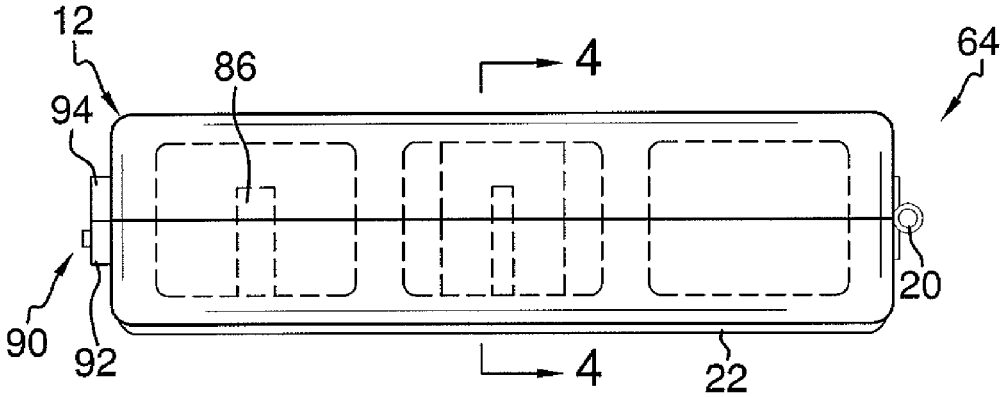
FIG. 3 is a side view of an embodiment of the disclosure.
Figure 4:
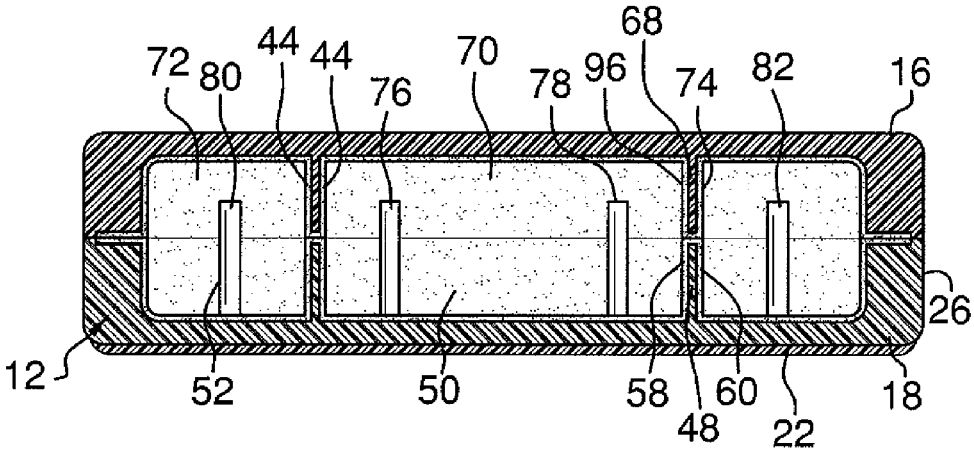
FIG. 4 is a cross-sectional view of an embodiment of the disclosure taken along line 4-4 of FIG. 3.

With reference now to the drawings, and in particular to FIGS. 1 through 4 thereof, a new jewelry storage device embodying the principles and concepts of an embodiment of the disclosure and generally designated by the reference numeral 10 will be described.

As best illustrated in FIGS. 1 through 4, the jewelry storage case 10 generally comprises a housing 12 having an interior 14 and a top 16 hingedly coupled to a bottom 18 by hinge 20. The bottom 18 has a planar lower surface 22, an upper edge 24, and a perimeter wall 26 extending between an outer perimeter 28 of the lower surface 22 and the upper edge 24.

A plurality of lower cups 38 is positioned in the bottom 18 of the housing 12. Each lower cup 38 is configured for receiving and holding a pair of earrings 40 or a ring 42. Each the lower cup 38 is lined by a protective fabric material 44 such as felt. An elongated lower channel 46 is positioned in the bottom 18 of the housing 12. The lower channel 46 is also lined by the protective fabric material 44. An elongated oblong lower wall 48 is positioned in the lower channel 46 defining a lower inner compartment 50 and a lower outer compartment 52 in the lower channel 46. The lower outer compartment 52 is configured for receiving and holding a long looped piece of jewelry such as a necklace 54. The lower inner compartment 50 is configured for receiving and holding a smaller looped piece of jewelry such as a bracelet 56. The lower wall 48 is lined on both an inwardly facing surface 58 and an outwardly facing surface 60 by the protective fabric material 44. The bottom 18 is positioned sufficiently close to the top 16 when the housing is in a closed position 64 to prevent the bracelet 56, necklace 54, earrings 40 or ring 42 from moving between the lower cups 38, lower outer compartment 52, and lower inner compartment 50 while the housing 12 is in the closed position 64.

A plurality of upper cups 62 may be positioned in the top 16 of the housing 12. Each upper cup 62 is positioned to align with an associated one of the lower cups 38 when the top 16 and the bottom 18 are in the closed position 64. Each upper cup 62 may also be lined by the protective fabric material 44. An elongated upper channel 66 is positioned in the top 16 of the housing 12. The upper channel 66 is positioned to align with the lower channel 46 when the top 16 and the bottom 18 are in the closed position 64. The upper channel 66 may also be lined by the protective fabric material 44. An elongated oblong upper wall 68 is positioned in the upper channel 66 defining an upper inner compartment 70 and an upper outer compartment 72 in the upper channel 66. The upper wall 68 is positioned to align with the lower wall 48 when the top 16 and the bottom 18 are in the closed position 64. The upper wall 68 may be lined on both an inwardly facing surface 72 of the upper wall 68 and an outwardly facing surface 74 of the upper wall 68 by the protective fabric material 44.

A pair of spaced posts 76,78 are positioned in the lower inner compartment 50 to prevent tangling of the bracelet 56 within the lower inner compartment 50. The posts 76,78 may extend upwardly into the upper inner compartment 70. The posts 76,78 may also be lined by the protective fabric material 44. Similarly, a pair of spaced pegs 80,82 may be positioned in the lower outer compartment 52 to prevent tangling of the necklace 54 within the lower outer compartment 52. The pegs 80,82 may extend upwardly into the upper outer compartment 72. The pegs 80,82 may also be lined by the protective fabric material 44 to protect the necklace 54.

Organizational indicia 84 may be positioned in a visible position adjacent to each lower cup 38. The indicia 84 may be arranged into separate days to permit organization of pieces of jewelry according to an intended date of use. This encourages planning ahead regarding what clothing and jewelry to wear on a given day and thus facilitates efficient use of time.

A pin 86 may be positioned in at least one the lower cups 38 to facilitate storage of a ring 88 or looped earrings. The pin 86 may extend upwardly into an aligned one of the upper cups 62 when the top 16 and bottom 18 are in the closed position 64. The pin 86 may also be lined with the protective fabric material 44.

A lock 90 has a first section 92 coupled to the bottom 18 and a second section 94 coupled to the top 16. The first section 92 is selectively securable to the second section 94 whereby the lock 90 secures the housing 12 in the closed position 64.

In use, the housing 12 stores and protects jewelry while it is not being worn or during periods of transportation such as a vacation. The housing 12 is opened to provide access to the interior 14. Jewelry is selected and may be placed into the lower cups 38 according to planned days of use as shown by indicia 84. A bracelet 56 and necklace 54 may be positioned in the lower inner compartment 50 and lower outer compartment 52 respectively around the posts 76,78 and pegs 80,82 respectively to prevent tangling. The housing 12 is closed and secured by lock 90. The housing 12 may then be transported and later opened as desired to provide access to the jewelry stored within the interior 14 of the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A jewelry case assembly comprising:

a housing having an interior and a top hingedly coupled to a bottom;

a plurality of lower cups positioned in said bottom of said housing, each lower cup being configured for receiving and holding a pair of earrings;

an elongated lower channel positioned in said bottom of said housing; and an elongated lower wall positioned in said lower channel defining a lower inner compartment and a lower outer compartment in said lower channel, said lower outer compartment being configured for receiving and holding a necklace, said lower inner compartment being configured for receiving and holding a bracelet; and a plurality of upper cups positioned in said top of said housing, each upper cup being positioned to align with an associated one of said lower cups when said top and said bottom are in a closed position.

2. A jewelry case assembly comprising:

a housing having an interior and a top hingedly coupled to a bottom;

a plurality of lower cups positioned in said bottom of said housing, each lower cup being configured for receiving and holding a pair of earrings;

an elongated lower channel positioned in said bottom of said housing; and an elongated lower wall positioned in said lower channel defining a lower inner compartment and a lower outer compartment in said lower channel, said lower outer compartment being configured for receiving and holding a necklace, said lower inner compartment being configured for receiving and holding a bracelet; and an elongated upper channel positioned in said top of said housing, said upper channel being positioned to align with said lower channel when said top and said bottom are in a closed position.

3. The assembly of claim 2, further including an elongated upper wall positioned in said upper channel defining an upper inner compartment and an upper outer compartment in said upper channel, said upper wall being positioned to align with said lower wall when said top and said bottom are in said closed position.

4. A jewelry case assembly comprising:

a housing having an interior and a top hingedly coupled to a bottom;

a plurality of lower cups positioned in said bottom of said housing, each lower cup being configured for receiving and holding a pair of earrings;

an elongated lower channel positioned in said bottom of said housing; and an elongated lower wall positioned in said lower channel defining a lower inner compartment and a lower outer compartment in said lower channel, said lower outer compartment being configured for receiving and holding a necklace, said lower inner compartment being configured for receiving and holding a bracelet; and a pair of spaced posts positioned in said lower inner compartment.

5. The assembly of claim 1, further including a pair of spaced pegs positioned in said lower outer compartment.

6. The assembly of claim 1, wherein each said lower cup, said lower channel, and said lower wall are lined by a protective fabric material.

7. The assembly of claim 1, wherein each said upper cup is lined by a protective fabric material.

8. The assembly of claim 3, wherein said upper channel and said upper wall are lined by a protective fabric material.

9. The assembly of claim 1, further including organizational indicia positioned adjacent to each said lower cup.

10. The assembly of claim 1, further including a pin positioned in at least one said lower cup.

11. The assembly of claim 1, further including a lock having a first section coupled to said bottom and a second section coupled to said top, said first section being selectively securable to said second section whereby said lock secures said housing in a closed position.

12. The assembly of claim 1, further comprising:

an elongated upper channel positioned in said top of said housing, said upper channel being positioned to align with said lower channel when said top and said bottom are in said closed position, said upper channel being lined by said protective fabric material;

an elongated upper wall positioned in said upper channel defining an upper inner compartment and an upper outer compartment in said upper channel, said upper wall being positioned to align with said lower wall when said top and said bottom are in said closed position, said upper wall being lined by said protective fabric material;

a pair of spaced posts positioned in said lower inner compartment, said posts extending upwardly into said upper inner compartment, said posts being lined by said protective fabric material;

a pair of spaced pegs positioned in said lower outer compartment, said pegs extending upwardly into said upper outer compartment, said pegs being lined by said protective fabric material;

organizational indicia positioned adjacent to each said lower cup;

a pin positioned in at least one said lower cup, said pin extending upwardly into one of said upper cups; and a lock having a first section coupled to said bottom and a second section coupled to said top, said first section being selectively securable to said second section whereby said lock secures said housing in a closed position.

* * * * *